US005507962A

United States Patent [19]

Jahanmir et al.

[11] Patent Number: 5,507,962

[45] Date of Patent: Apr. 16, 1996

[54] METHOD OF FABRICATING ARTICLES

[75] Inventors: Said Jahanmir, Germantown; Guangming Zhang, Greenbelt, both of Md.

[73] Assignee: The United States of America as represented by the Secretary of Commerce, Washington, D.C.

[21] Appl. No.: 62,534

[22] Filed: May 18, 1993

[51] Int. Cl.[6] ..... C10M 173/00

[52] U.S. Cl. ..... 252/49.3; 252/49.5; 252/49.6; 72/42

[58] Field of Search ..... 252/49.6, 49.3, 252/49.5; 72/42

[56] References Cited

U.S. PATENT DOCUMENTS

| | | | |
|---|---|---|---|
| H 125 | 9/1986 | Nordquist, Jr. | 252/79.4 |
| 2,999,064 | 9/1961 | Sluhan | 252/34.7 |
| 3,186,946 | 6/1965 | Sluhan | 252/49.3 |
| 3,629,112 | 12/1971 | Gower et al. | 252/34.7 |
| 3,719,598 | 3/1973 | King | 252/33.4 |
| 3,769,214 | 10/1973 | Davis . | |
| 3,953,217 | 4/1976 | Goracke | 106/8 |
| 4,115,286 | 9/1978 | Baldwin et al. . | |
| 4,138,348 | 2/1979 | Grasshoff . | |
| 4,209,414 | 6/1980 | Holgado et al. | 252/75 |
| 4,218,329 | 8/1980 | Koh | 252/46.4 |
| 4,448,701 | 5/1984 | Duerksen et al. | 252/49.3 |
| 4,650,595 | 3/1987 | Nagamori et al. | 252/32.5 |
| 4,956,110 | 9/1990 | Lenack et al. . | |
| 4,965,002 | 10/1990 | Brannen et al. . | |
| 5,171,903 | 12/1992 | Koyama et al. | 252/49.3 |

FOREIGN PATENT DOCUMENTS

| | | | |
|---|---|---|---|
| 328601 | 3/1976 | Austria . | |
| 85100129 | 7/1986 | China . | |
| 1031107 | 2/1989 | China . | |
| 226972 | 1/1986 | Czechoslovakia . | |
| 116348 | 8/1984 | European Pat. Off. . | |
| 120665 | 10/1984 | European Pat. Off. . | |
| 206833 | 12/1986 | European Pat. Off. . | |
| 101087 | 10/1973 | Germany . | |
| 1620447 | 8/1975 | Germany . | |
| 130420 | 3/1978 | Germany | C10M 3/02 |
| 332100 | 10/1984 | Hungary . | |
| 54-031683 | 3/1979 | Japan . | |
| 56-072183 | 6/1981 | Japan | C23F 11/18 |
| 61-081477 | 4/1986 | Japan . | |
| 61-015119 | 4/1986 | Japan . | |
| 01287190 | 11/1989 | Japan . | |
| 261083 | 1/1970 | U.S.S.R. . | |
| 559945 | 5/1977 | U.S.S.R. . | |
| 583156 | 12/1977 | U.S.S.R. | C10M 3/02 |
| 600167 | 3/1978 | U.S.S.R. . | |
| 709667 | 1/1980 | U.S.S.R. | C10M 3/02 |
| 836077 | 6/1981 | U.S.S.R. . | |
| 914617 | 3/1982 | U.S.S.R. . | |
| 1018964 | 5/1983 | U.S.S.R. . | |
| 1482934 | 5/1989 | U.S.S.R. . | |

OTHER PUBLICATIONS

Peterson et al., "Consideration of Lubricants for Temperatures above 1000 F", ASLE Trans., vol. 2, pp. 225–234 (1960). month unavailable.

Hernandez et al., "The Various Factors . . . Aqueous Cutting Fluid", Lubrication Engineering, vol. 41 (7), 425–429 (Jul., 1985).

Erdemir, "Tribological Properties of . . . Self–Lubrication of Boric Acid", Lubrication Engineering, vol. 47 (3), 168–173, (Mar., 1991).

Erdemir et al., "Relationship of hertzian . . . boric acid films", Surface and Coatings Tech., 49 (1991) 435–438.

Erdemir et al., "Tribological Properties of . . . Oxide–Containing Surfaces", Lubrication Engineering, vol. 47 (3), pp. 179–184 (Mar., 1991).

Erdemir et al., "A Study of . . . Boric Oxide Coatings", Surface and Coatings Tech., 43/44 (1990) 588–596. month unavailable.

Johnson et al., "Ceramic Surface Films . . . Temperatures to 2000° F.", Ceramic Bulletin, vol. 41, No. 8, 504–508 (1962). month unavailable.

Jahanmir et al., "Ceramic Machining: . . . the United States", NIST Special Pub. 834, pp. 1–15, 21–24, 27–35 (Jun. 1992).

Rekow et al., "Factorial Design Technique . . . on Surface Finish", IADR Abstract 570, 10 pp. (Mar. 10, 1993).

Zhang et al., "Tribological Interaction . . . Oxide Ceramics", U.S. Tribology/Workshop, 5 pp. (May 1992).

Zhang et al., "Study of the . . . Machining of Ceramics", NSF Grantees Meeting, Charlotte, N.C., 26 pp. (Jan. 1993).

Kachan, V. I., et al., "Lubricating and . . . improved Bio–restiviity", Chem. and Tech. of Fuels and Oils, v. 25, No. 11–12, Jul. 1990, pp. 623–6625.

Shiraishi, M., et al., "Isothermal forging of . . . with ceramic tools", Trans. of the Japan Society of Mech. Engineers, Part C, v. 55, No. 516, Aug. 1989, pp. 2192–2198.

*Primary Examiner*—Jacqueline V. Howard
*Attorney, Agent, or Firm*—Leydig, Voit & Mayer

[57] ABSTRACT

A method of fabricating articles, such as an oxide ceramic article, is disclosed. The method includes cutting an oxide ceramic workpiece in a cutting zone and applying a cutting fluid to the cutting zone. The cutting fluid includes an aqueous solution which contains a sufficient amount of a boron compound to effectively provide lubrication. The boron compound is selected from the group consisting of boric acid, alkali metal borates, aluminum borate, and mixtures thereof. A method of fabricating articles, which includes cutting a workpiece in a cutting zone with an oxide ceramic cutting point and applying a cutting fluid to the cutting zone is also disclosed.

27 Claims, No Drawings

METHOD OF FABRICATING ARTICLES

TECHNICAL FIELD OF THE INVENTION

The present invention relates to a method of fabricating articles. More particularly, the invention relates to cutting oxide ceramic workpieces or to cutting workpieces with an oxide ceramic cutting point.

BACKGROUND OF THE INVENTION

Structural ceramics typically have many properties, e.g., high strength at elevated temperatures, excellent resistance to chemical degradation and wear, and low density, that make them attractive materials for many high performance applications. High fabrication costs and uncertain reliability, however, create considerable barriers to the utilization of these materials. Both the cost and performance of ceramic materials are strongly influenced by machining operations. Machining costs make up a large component of the cost of structural ceramics, sometimes constituting as much as 90% of the total fabrication costs. In addition, the performance and reliability of ceramic articles are strongly influenced by the presence of machining-induced damage.

Ceramic materials are generally more difficult to machine than metals. Ceramic materials are defined as non-metallic inorganic materials which are formed via high temperature processing. Because of their hardness, the machining of ceramic materials usually requires a normal (feed) cutting force that is higher than that required for metals. Additionally, while metals are ductile, ceramic materials are typically quite brittle. As a result of these factors, the machining of ceramic materials is likely to produce machining-induced damage in the finished ceramic article and lead to increased cutting tool wear rates (in comparison to metals). Overall, the machining of ceramic materials places stringent demands on the performance of cutting tools and cutting fluids. The latter are customarily used to provide cooling and lubrication during machining operations.

Where possible, it is preferable to carry out the machining of ceramic materials through conventional cutting operations, such as turning, milling or drilling. These operations are capable of producing articles with high precision. For example, turning of ceramic materials using a single diamond cutting point is typically employed to produce highly smooth and precise surface contours for specialized applications, such as optical components. However, with cutting operations such as turning, special precautions to minimize tool wear are required. Damage to the cutting point may lead to a failure to achieve desired tolerances and can contribute to an increase in the machining-induced damage in the finished ceramic article.

Many ceramic materials are too hard to be machined by cutting techniques and may only be fabricated by abrasive machining operations, such as grinding and polishing, which are characterized by low productivity. As a result, the use of such ceramics is often not favored in comparison to metal superalloys, which may be fabricated more readily. In order for ceramic materials to compete directly with metals in many high performance applications, significant advances in machining techniques to permit the rapid, economical fabrication of ceramic articles must occur.

Most nitride and carbide ceramics are too hard to be machined using cutting techniques. Oxide ceramic materials, which typically are somewhat easier to machine, offer more promise as potential workpieces for these rapid machining methods. An oxide ceramic is defined to be any ceramic material, which includes a substantial amount, i.e., at least about 20%, of an inorganic oxide (e.g., alumina, silica, aluminosilicate or zirconia). There is considerably more experience with the design and fabrication of oxide ceramics than with other ceramic materials. In addition, for many applications oxide ceramic materials may possess better resistance to chemical degradation than metal alloys or other ceramics. Further, oxide ceramics are, as a rule, substantially less expensive than nitride or carbide ceramics. In view of these advantages, oxide ceramics appear to offer the most potential to satisfy the demand for readily and economically fabricated ceramic materials.

In comparison to abrasive methods of machining ceramics, such as grinding or polishing, cutting operations typically generate higher levels of machining-induced damage in a finished ceramic workpiece. In order to permit ceramic articles to be routinely fabricated, cutting methods which avoid excessive machining-induced damage to the workpiece and achieve acceptable tool wear rates must be available.

In cutting a ceramic workpiece, the removal of material occurs in the cutting zone, i.e., the interface between the cutting point (or points) and the workpiece surface. In this interaction, the workpiece surface undergoes elastic and plastic deformation, followed by the fracture of small particles or chips from the surface. Whether deformation or fracture dominates the removal process depends on the properties of the workpiece material and the cutting conditions. With ceramics that exhibit a low toughness, the removal of material often occurs by a brittle fracture process, resulting in a machined surface that contains damage in the form of microcracks. Since the processes of deformation and fracture are related to the forces applied at the interface of the workpiece surface with the cutting point, any reduction of these forces decreases the tendency of the workpiece to fracture in an uncontrolled manner. In the cutting of a ceramic workpiece, cutting conditions that increase the removal rate, while at the same time minimizing the level of machining-induced damage, are to be desired.

Cutting fluids may have a substantial effect on cutting efficiency and tool wear, as well as on the surface finish and the surface and subsurface damage of the finished ceramic article. In addition to reducing contact forces, which may be accomplished by using additives in the cutting fluid that reduce the coefficient of friction, the cutting process may also be improved by controlling the temperature during the cutting operation. The ability of a cutting fluid to remove heat is an extremely important factor, since the thermal stresses associated with high local temperatures may lead to the formation of large microcracks during the cutting of ceramic workpieces with low thermal conductivity. These microcracks may later lead to the fracture and failure of the finished ceramic article. The reduction of friction at the cutting zone decreases the overall temperature in cutting, since approximately 50% of the heat is generated from sliding in the cutting zone, i.e., at the tool/workpiece and the chip/tool interfaces. The remaining heat is generated from deformations of the workpiece in the shear zone.

In general, cutting fluids used in machining may be classified into three groups: mineral oils, soluble oils and chemical (synthetic) fluids. Of these three, both soluble oils and chemical fluids are water-based. Minerals oils, which include a variety of performance enhancing additives, are generally used in the low speed grinding of ceramics and in metal cutting operations. Mineral oil cutting fluids typically have very good lubricating properties but do not perform as well as water-based cutting fluids in controlling temperature.

In cutting operations with a large degree of heat generation, as for example in the cutting of a ceramic workpiece, water-based cutting fluids are typically employed due to the high heat capacity of water. Conventional soluble oils and chemical fluids, however, both suffer from disadvantages.

Soluble oils are emulsions of oil in water, generally containing a much greater amount of water than oil. While soluble oils may have the high heat capacity of water-based fluids in addition to the lubricating properties of mineral oils, a major drawback of soluble oil cutting fluids is their milky color. This milky color may obscure vision in the cutting zone.

Chemical fluids are aqueous solutions of water-soluble additives, which usually are present as about 5–10 wt. % of the cutting fluid. While these fluids have excellent cooling capacities and are transparent, chemical fluids do not typically have the lubricating capability of either mineral oils or soluble oils.

As enumerated above, conventional cutting fluids have a number of drawbacks for machining ceramic workpieces and, in particular, for use in cutting ceramic workpieces where higher temperatures may be experienced. The environmental aspects and disposal problems associated with expended cutting fluids are also extremely important issues in the design and selection of cutting fluid additives. Additives should, if at all possible, preferably be non-toxic, non-flammable, biodegradable, and not present any handling problems. There is, accordingly, a continuing need for safe, inexpensive water-based cutting fluids with effective friction reducing capabilities, which may be used in the cutting of ceramic workpieces, and in particular, which may be used in cutting oxide ceramic materials.

Several publications have shown that a coating of solid boric oxide or solid boric acid (i.e., essentially free of any liquid) may act as a lubricant in reducing the coefficient of friction between contacting surfaces. Typically, the solid coating is formed on at least one of the surfaces to be lubricated using either boric acid or boric oxide in powdered form.

Boric acid has also been proposed and/or employed as an additive in metal cutting fluids, which may be used in the cutting, grinding, polishing, or forming of metals. In many of these applications, the boric acid is reacted with amines, fatty acids, alcohols, or other hydrocarbons to form chemical adducts that are utilized for friction reduction, corrosion protection, and as bactericides and fungicides. In other applications, boric acid and hydrocarbon compounds are mixed with water for use as cutting fluids. In such cases, although the boric acid is not intentionally reacted with the hydrocarbon compounds, chemical adducts are believed to be formed under the cutting conditions.

In addition, boric acid has been reported as being among a number of additives in multi-component mixtures used in conjunction with the drilling, polishing or grinding of rocks, refractories, glass or ceramic articles. For example, aqueous solutions, which include sodium tripolyphosphate, sodium tetraborate, triethanolamine and boric acid together with other additives such as hydrofluoric acid, ammonium flourosilicate, or hexamethylenetetramine, have been employed as cutting fluids for the processing or machining of ceramic articles. Multicomponent mixtures such as these are more likely to be expensive, may prove to be more difficult to optimize and are more likely to present environmental and/or handling issues.

SUMMARY OF THE INVENTION

The object of the present invention is to provide a method of fabricating an oxide ceramic article which overcomes the problems described above.

According to one aspect, the present invention provides a method of fabricating an oxide ceramic article which includes cutting an oxide ceramic workpiece in a cutting zone and applying a cutting fluid to the cutting zone. The cutting fluid includes an aqueous solution which contains a sufficient amount of a boron compound to effectively provide lubrication. The boron compound is selected from the group consisting of boric acid, alkali metal borates, alkaline earth borates, aluminum borate, and mixtures thereof.

According to another aspect, the present invention provides a method of fabricating a steel article which includes cutting a steel workpiece with at least one oxide ceramic cutting point. The method of this embodiment includes cutting the steel workpiece in a cutting zone with the oxide ceramic cutting point and applying a cutting fluid, which includes an aqueous solution which contains a sufficient amount of a boron compound to provide effective lubrication, to the cutting zone. The steel workpiece may include carbon steel, stainless steel or alloy steel.

Still another aspect of the invention is directed to a method of fabricating an oxide ceramic article including cutting an oxide ceramic workpiece with at least one cutting point; and applying a cutting fluid to the cutting point and the workpiece. The cutting fluid is an aqueous solution which includes at least about 1 wt. % boric acid.

The present invention provides a safe, cost-effective, environmentally acceptable, water-based cutting fluid for use in cutting oxide ceramic workpieces. Further, the use of this cutting fluid in the present method reduces the tangential cutting force while maintaining or increasing the normal (feed) cutting force. This combination of effects gives rise to a resultant cutting force which enhances the cutting effect. The increase in the normal component also leads to an attenuation of tool vibration and improves the retention of the cutting point in the cutting zone. Moreover, decreasing the tangential component of the cutting force reduces power consumption during cutting.

In addition to lowering the tangential cutting force during cutting, the present invention provides a means of maintaining the cutting point and ceramic workpiece at lower temperatures during cutting operations. This is due to the lubricating and cooling properties of the cutting fluid. The combination of these factors permits oxide ceramic articles to be cut with a reduction in the machining-induced damage in the surface of the ceramic, i.e., with a reduction in the number and size of microcracks in the machined surface and in the amount of debris redeposited on the surface. The method of this invention also allows oxide ceramics to be cut to higher tolerances and to an improved surface finish (as evidenced by a lower surface roughness).

Further, the lubricating and heat removal properties of the cutting fluid of the present invention permits increased cutting rates and prolonged life of the cutting tool. When coupled with the reduction in power requirements and the relatively low cost of the components of the cutting fluid, the present method may lead to a major reduction in the total fabrication costs of a ceramic article.

These and other objects and advantages of the present invention will be apparent from the description of the invention which follows.

DETAILED DESCRIPTION OF THE INVENTION

The present invention relates to a method of fabricating an oxide ceramic article which includes cutting an oxide ceramic workpiece and applying a cutting fluid to the cutting zone.

For the purposes of the present invention, oxide ceramics include crystalline materials, glass-bonded crystalline aggregates and wholly amorphous materials. Oxide ceramics also include composite materials, which include a substantial amount, e.g., at least 20% and preferably at least 50 wt. % of an inorganic oxide, together with other non-metallic inorganic materials, such as inorganic carbides, nitrides or borides.

The workpiece in the method of the present invention may be configured in any one of a large variety of shapes, including disks, cylinders, sheets, blocks or more complex shapes. The precise configuration of any given workpiece will obviously depend on the particular requirements of the intended application.

The workpiece may include any oxide ceramic material which is capable of being cut, e.g., of being turned or milled. Typically, the workpiece includes aluminum oxide, silicon oxide, zirconia, aluminosilicate or glass ceramic. Preferably, the workpiece includes aluminum oxide or a glass ceramic. The aluminum oxide may be α-aluminum oxide or any phase or type of aluminum oxide. For some applications, the workpiece may include a single crystal α-aluminum oxide, e.g. sapphire.

The present invention is also useful for cutting workpieces which include a glass ceramic material, such as a mica-reinforced glass ceramic. For example, a DICOR-MGC™ workpiece may be fabricated into a ceramic article using the method of the present invention. DICOR-MGC is a tetrasilicic mica glass-ceramic based on a simple $K_2O$—$MgF_2$—MgO—$SiO_2$ quaternary system with additions of alumina and zirconia. The microstructure of this material consists of about 70 volume percent randomly oriented mica crystals uniformly dispersed in a non-porous glass. Other exemplary glass ceramics which may be used as workpieces with the present method include those materials usually identified as machinable glass ceramics.

For the purposes of this invention, cutting a ceramic workpiece is defined to include turning, milling or drilling the workpiece. In these operations, the cutting tool may have single or multiple cutting points. In some operations, such as single-point turning, a cutting tool having only a single cutting point may be used. Single-point turning may be carried out using either a sintered polycrystalline diamond cutting point or a single crystal (monocrystalline) diamond cutting point. In other operations, such as milling or drilling, a plurality of cutting points may be employed.

The cutting point(s) should be sufficiently hard and strong to penetrate the workpiece and to withstand the interactive forces encountered during chip removal. Preferably, the ratio of the hardness (in GPa) of the cutting point to the hardness of the ceramic workpiece being machined should be at least about 3:1, and more preferably at least about 5:1. In addition, the cutting point should have a high resistance to the thermal and chemical degradative processes encountered during cutting. The cutting point typically includes a material with good flexural strength, fracture toughness, thermal conductivity and chemical inertness. These properties are important in determining the ability of a cutting point to sustain cutting action with low wear rates. Minimizing cutting point wear is an extremely important factor both in reducing the cost of cutting ceramic workpieces and in avoiding workpiece damage and poor cutting performance.

The cutting point may include exemplary materials such as diamond, tungsten carbide, silicon carbide, steel, cubic boron nitride, silicon nitride, sialon and aluminum oxide. The cutting point may also include a ceramic composite, such as a composite formed from alumina, silicon nitride, silicon carbide or sialon and other particulates or whiskers. Other suitable cutting points which may be used in the present invention, include coated cutting points, e.g., cutting points which are coated with a layer of tungsten carbide, titanium carbide or diamond. Due to its extreme hardness and durability, diamond may be utilized in cutting points for cutting a wide variety of oxide ceramic workpieces. Either monocrystalline or polycrystalline diamond may be used depending on the particular composition of the workpiece and on the type of cutting operation. With softer oxide ceramic workpieces, such as glass ceramics, cutting points which include tungsten carbide, aluminum oxide, silicon nitride, sialon or steel may be utilized.

The present invention includes the step of applying a cutting fluid to the workpiece, and preferably to the cutting point and the workpiece. In another preferred embodiment, the cutting fluid is applied to the cutting zone, i.e., to the cutting point-workpiece and cutting point-chip interfaces. Typically, the cutting fluid is continuously sprayed onto the workpiece or the cutting zone during cutting operations. The cutting fluid serves a number of functions. The primary functions are to carry away chips produced by the cutting process and to control the temperature of the workpiece and the cutting point. In addition, the cutting fluid may also serve to lubricate the cutting zone, thereby limiting the frictional heating that occurs during cutting. Although the mechanism by which the cutting fluid lubricates the workpiece in the present method is not fully understood, it is believed that the boron compound may react with and thereby become incorporated into the surface of the workpiece.

In one embodiment, the cutting fluid includes an aqueous solution which contains a sufficient amount of a boron compound to effectively provide lubrication. The boron compound is typically selected from the group consisting of boric acid, alkali metal borates, (e.g., sodium borate, which is also known as sodium tetraborate), alkaline earth borates, (e.g., magnesium borate or calcium borate), aluminum borate, and mixtures thereof. The aqueous solution of the boron compound may be prepared using dehydrated forms of boric acid, e.g., boric oxide ($B_2O_3$), metaboric acid ($HBO_2$) or pyroboric acid ($H_2B_4O_7$), as well as from boric acid or a salt of boric acid. Preferably, the cutting fluid includes at least about 1 wt. % boric acid. More preferably, the cutting fluid includes from about 2 wt. % to about 6 wt. % and, most preferably, about 4 wt. % boric acid.

In another preferred embodiment, the cutting fluid is an aqueous solution of the boron compound. In yet another preferred embodiment, the cutting fluid is an aqueous solution which includes at least about 1 wt. % boric acid, and more preferably about 4 wt. % boric acid.

The cutting fluid typically has a pH which is close to neutral. Preferably, the pH of the cutting fluid is from about 5 to about 9 and, more preferably, from about 6 to about 8. If the pH of the cutting fluid is below about 5 or is greater than about 9, excessive corrosion of the machine tool components may occur.

The cutting fluid may be made using any reasonably pure water, that is any water which is substantially free of particulates, such as ordinary tap water. Preferably, the cutting fluid is also substantially free of organic compounds, e.g., alcohols, and/or of an inorganic phosphorus-containing compounds or salts thereof.

In one embodiment of the present invention, high purity water is used to produce the cutting fluid. For the purposes of this invention, high purity water includes any water which is substantially free of particulates, dissolved solids and soluble organic compounds. For example, high purity water may be obtained by a number of methods including distillation, passage through an ion exchange resin, or by passage through a semipermeable membrane, e.g. by reverse osmosis.

A number of specific embodiments of the present invention are described in the examples set forth below. These examples are offered by way of illustration and not by way of limitation.

EXAMPLE 1

Turning of Aluminum Oxide Workpieces

High-purity aluminum oxide (Coors AD998) workpieces were turned on a CNC machining center using polycrystalline diamond compact tool inserts. The workpieces were turned under a variety of conditions which included variations in the depth of cut (0.10–0.20 mm), feed rate (5–10 mm/min) and spindle speed (400–600 rpm). The turning experiments were carried out using one of four different cutting fluids, (i) a mineral oil (ii) pure distilled water, (iii) a solution of 1 wt. % boric acid in distilled water or (iv) a solution of 4 wt. % boric acid in distilled water. During turning operations, the tangential and normal cutting forces were measured using a set of strain gauges attached to the tool holder. The surface roughness of the finished ceramic articles, produced by turning the aluminum oxide workpieces, was determined by surface profilometer.

In comparison with pure water or a commercial cutting fluid, a reduction in machine tool vibration and noise was observed with the addition of boric acid to water. The use of the 4 wt. % boric acid solution as a cutting fluid produced a slight increase in the normal cutting force (relative to pure water). The tangential cutting force under all turning conditions was reduced by the use of the 4 wt. % boric acid cutting fluid (relative to either mineral oil or pure water). A reduction in the tangential cutting force was also obtained using the 1 wt. % boric acid cutting fluid (relative to pure water). The extent of the reduction was not as great as that seen with the 4 wt. % boric acid solution.

The average surface roughness over all the turning experiments was 1.10 micrometers with the aqueous 4 wt. % boric acid cutting fluid versus 2.06 micrometers using pure distilled water as the cutting fluid. A relative reduction in surface roughness as high as 79% was achieved under comparable turning conditions with the aqueous 4 wt. % boric acid cutting fluid (versus that achieved using pure water). The lowest values of surface roughness achieved using the 4 wt. % boric acid solution, i.e., 0.53–0.63 micrometers, are acceptable values for many engineering applications. Workpieces turned with the aqueous 4 wt. % boric acid also showed an improvement in surface quality, i.e., the formation of fewer and smaller microcracks, in contrast with workpieces turned with pure distilled water as the cutting fluid.

EXAMPLE 2

Milling of Mica-Reinforced Glass Ceramic Workpieces

Mica reinforced glass dental ceramic (DICOR-MGC) workpieces were milled using a high speed steel end mill. The workpieces were milled under a variety of milling conditions which included variations in the depth of cut (0.05–0.10 mm), feed rate (10–20 mm/min)and spindle speed (200–400 rpm). During milling operations, a cutting fluid spray was introduced at the cutting tool-workpiece interface. The milling experiments were carried out using one of two different cutting fluids, pure distilled water or a solution of 4 wt. % boric acid in distilled water.

The surface roughness of the finished ceramic articles, produced by milling the glass ceramic workpieces, was determined by surface profilometer. A relative reduction in surface roughness as high as 79% was achieved with the aqueous boric acid cutting fluid. The average surface roughness over all the milling experiments was 4.96 micrometers using pure distilled water as the cutting fluid versus 3.39 micrometers with the aqueous boric acid cutting fluid.

EXAMPLE 3

Turning of Stainless Steel Workpieces with Oxide Ceramic Cutting Points

Stainless steel workpieces may be turned on a CNC machining center using oxide ceramic tool inserts. The workpieces may be turned under a variety of conditions which include variations in the depth of cut, feed rate and spindle speed. The turning experiments may be carried out using one of three different cutting fluids, (i) pure distilled water, (ii) a solution of 1 wt. % boric acid in distilled water or (iii) a solution of 4 wt. % boric acid in distilled water.

The surface roughness of the finished stainless steel articles, produced by turning the stainless steel workpieces, may be determined by surface profilometer. A relative reduction in surface roughness may be achieved with the aqueous boric acid cutting fluids as compared to the use of pure distilled water as the cutting fluid.

Although the present invention has been described in terms of exemplary embodiments, it is not limited to these embodiments. Alternative embodiments, examples, and modifications which would still be encompassed by the invention may be made by those skilled in the art, particularly in light of the foregoing teachings. Therefore, the following claims are intended to cover any alternative embodiments, examples, modifications, or equivalents which may be included within the spirit and scope of the invention as defined by the claims.

What is claimed is:

1. A method of fabricating an oxide ceramic article comprising cutting an oxide ceramic workpiece in a cutting zone, and applying a cutting fluid which includes an aqueous solution containing a sufficient amount of a boron compound to effectively provide lubrication to the cutting zone, wherein the boron compound is selected from the group consisting of boric acid, boric oxide, alkali metal borates, alkaline earth metal borates, aluminum borate, and mixtures thereof, wherein said aqueous solution is substantially free of organic compounds.

2. The method according to claim 1 wherein cutting the oxide ceramic workpiece comprises turning, milling or drilling the workpiece.

3. The method according to claim 2 comprising turning, milling or drilling the workpiece with at least one cutting point.

4. The method according to claim 3 comprising turning the workpiece with a single cutting point.

5. The method according to claim 1 comprising cutting an oxide ceramic workpiece, which includes aluminum oxide, silicon oxide, zirconia, aluminosilicate or glass ceramic.

6. The method according to claim 5 wherein the glass ceramic comprises a mica-reinforced glass ceramic.

7. The method according to claim 5 wherein the aluminum oxide comprises α-aluminum oxide.

8. The method according to claim 1 wherein the cutting fluid includes at least about 1 wt. % boric acid.

9. The method according to claim 1 wherein the boron compound is boric acid.

10. The method according to claim 3 wherein the cutting point comprises diamond, silicon carbide, tungsten carbide, steel, cubic boron nitride, silicon nitride, sialon, aluminum oxide or titanium carbide.

11. The method according to claim 3 wherein the cutting point is a coated cutting point.

12. The method according to claim 1 wherein applying the cutting fluid to the workpiece comprises spraying the cutting fluid onto the cutting zone.

13. The method according to claim 1 wherein the cutting fluid comprises high purity water.

14. The method according to claim 1 wherein the cutting fluid has a pH of from about 5 to about 9.

15. The method according to claim 1 wherein the cutting fluid is substantially free of an inorganic phosphorus-containing compound or a salt thereof.

16. The method according to claim 1 wherein cutting the oxide ceramic workpiece comprises turning an aluminum oxide ceramic workpiece with a single cutting point which includes diamond; and wherein the cutting fluid comprises about 4 wt. % boric acid in water.

17. The method according to claim 1 wherein cutting the oxide ceramic workpiece comprises milling a mica-reinforced glass ceramic workpiece with at least one cutting point, which includes tungsten carbide or steel; and wherein the cutting fluid comprises about 4 wt. % boric acid in water.

18. A method of fabricating a ceramic workpiece comprising:

turning, milling, or drilling an oxide ceramic workpiece with at least one cutting point; and applying a cutting fluid, which is an aqueous solution of boric acid, said solution being substantially free of organic compounds, to the workpiece and the cutting point.

19. The method according to claim 18 comprising turning the oxide ceramic workpiece with a single cutting point.

20. A method of fabricating a steel article comprising cutting a steel workpiece in a cutting zone with at least one oxide ceramic cutting point, and applying a cutting fluid which includes an aqueous solution containing a sufficient amount of a boron compound to effectively provide lubrication to the cutting zone, wherein the boron compound is selected from the group consisting of boric acid, boric oxide, alkali metal borates, alkaline earth metal borates, and mixtures thereof, wherein said aqueous solution is substantially free of organic compounds.

21. A method of fabricating an oxide ceramic article comprising cutting an oxide ceramic workpiece in a cutting zone, and applying a cutting fluid consisting essentially of water and a sufficient amount of a boron compound to effectively provide lubrication to the cutting zone, wherein said boron compound is selected from the group consisting of boric acid, boric oxide, alkali metal borates, alkaline earth metal borates, aluminum borate, and mixtures thereof.

22. A method of fabricating a ceramic workpiece comprising:

turning, milling, or drilling a ceramic workpiece with at least one cutting point; and applying a cutting fluid consisting essentially of water and boric acid to the workpiece and the cutting point.

23. A method of fabricating a steel article comprising cutting a steel workpiece in a cutting zone with at least one oxide ceramic cutting point, and applying a cutting fluid consisting essentially of water and a sufficient amount of a boron compound to effectively provide lubrication to the cutting zone, wherein the boron compound is selected from the group consisting of boric acid, boric oxide, alkali metal borates, alkaline earth metal borates, and mixtures thereof.

24. A method according to claim 21, wherein said aqueous solution is substantially free of inorganic phosphorus-containing compounds or any salt thereof.

25. A method according to claim 22, wherein said aqueous solution is substantially free of inorganic phosphorus-containing compounds or any salt thereof.

26. A method according to claim 23, wherein said aqueous solution is substantially free of inorganic phosphorus-containing compounds or any salt thereof.

27. A method according to claim 18, wherein said cutting fluid includes at least about 1 wt. % boric acid.

* * * * *